US005836254A

United States Patent [19]

Johansson

[11] Patent Number: 5,836,254

[45] Date of Patent: Nov. 17, 1998

[54] PALLET AND METHOD FOR THE MANUFACTURING OF THE PALLET

[75] Inventor: Sixten Johansson, Eskilstuna, Sweden

[73] Assignee: OLV Pallen Aktiebolag, Fellingsbro, Sweden

[21] Appl. No.: 817,088

[22] PCT Filed: Sep. 25, 1995

[86] PCT No.: PCT/SE95/01089

§ 371 Date: Apr. 11, 1997

§ 102(e) Date: Apr. 11, 1997

[87] PCT Pub. No.: WO96/11852

PCT Pub. Date: Apr. 25, 1996

[30] Foreign Application Priority Data

Oct. 17, 1994 [SE] Sweden ..... 9403530

[51] Int. Cl.[6] ..... B65D 19/00

[52] U.S. Cl. ..... 108/51.3

[58] Field of Search ..... 108/51.3, 57.3, 108/56.3, 51.11

[56] References Cited

U.S. PATENT DOCUMENTS

| | | | |
|---|---|---|---|
| 2,951,669 | 9/1960 | Davidson | 108/51.3 |
| 3,131,656 | 5/1964 | Houle | 108/56.3 X |
| 3,683,822 | 8/1972 | Roberts et al. | 108/51.3 |
| 4,759,295 | 7/1988 | Nilsen et al. | 108/51.3 |
| 4,867,074 | 9/1989 | Quasnick | 108/51.3 |
| 5,184,558 | 2/1993 | Wozniacki | 108/51.3 |
| 5,207,631 | 5/1993 | Schmidtke et al. | 108/51.3 X |
| 5,487,345 | 1/1996 | Winebarger et al. | 108/51.3 |
| 5,490,465 | 2/1996 | Hoyt et al. | 108/51.3 |

FOREIGN PATENT DOCUMENTS

| | | | |
|---|---|---|---|
| 252584 | 6/1964 | Australia | 108/51.3 |
| 354 459 | 12/1973 | Sweden . | |

*Primary Examiner*—Jose V. Chen

*Attorney, Agent, or Firm*—Nikaido, Marmelstein, Murray & Oram LLP

[57] ABSTRACT

A pallet having a plurality of parallel base beams, and a deck joined to the plurality of parallel base beams. The deck includes a web or sheet of material, which is folded to form a deck surface with a plurality of parallel panels adjoining each other, and a plurality of parallel projections on an underside thereof. Each base beam extends upward to contact the underside of the parallel panels, and includes at least one through-recess having a shape which corresponds to a cross-section of a corresponding one of the plurality of parallel projections. The corresponding parallel projection engages the recess thereby forming the pallet with a plurality of spaces to accommodate lifting forks between the plurality of parallel base beams. Lower surfaces of the plurality of parallel projections form lifting surfaces for the lifting forks.

27 Claims, 7 Drawing Sheets

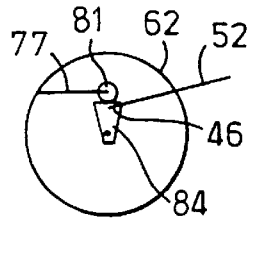
Fig.11A.
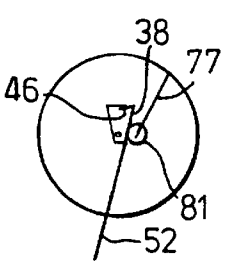
Fig.11B.
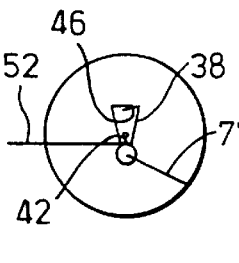
Fig.11C.
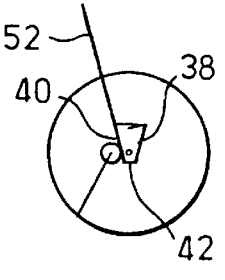
Fig.11D.
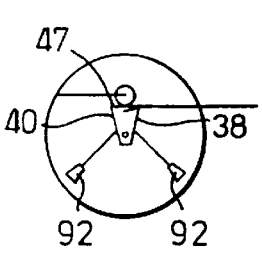
Fig.11E.
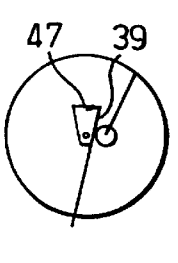
Fig.11F.
Fig.11G.
Fig.11H.
Fig.11I.
Fig.11J.
Fig.11K.
Fig.11L.

PALLET AND METHOD FOR THE MANUFACTURING OF THE PALLET

TECHNICAL FIELD

The invention relates to a pallet comprising a number of parallel base beams and a deck which is joined to the base beams. The invention also relates to a method for the manufacturing of the pallet, a blank for the manufacturing of a base beam, and an apparatus for the manufacturing of such base beams.

BACKGROUND OF THE INVENTION

Pallets made of cardboard, paper and/or paperboard have previously been proposed with the primary aim of offering a cheaper and easier alternative to conventional pallets made of wood. However, these pallets have not gained general acceptance. The reasons for this have generally lain in features such as too poor a load-bearing capacity, difficulty of handling with lifting forks, too high a price in relation to the technical qualities of the pallet, prohibitive costs for transport from producer to user, difficulties in recovering the material, etc.

The object of the invention is to tackle this set of problems. The invention aims in particular to afford the following advantages:

- The pallet will be of such a construction that it can suitably be produced at or near the site of the user. The storage space for pallets can be drastically reduced in this way. Instead, sheets or web-shaped material can be stored for producing the pallets, which takes up much less space.
- The pallet has a very good load-bearing capacity both in absolute terms and in particular in relation to its own weight.
- The space-consuming transportation of pallets from the producer to the user is discontinued and is replaced by transportation of the starting material, which can consist, for example, of sized cardboard in sheet stacks.
- The logistical problem of producing the correct number of pallets at the site of the external pallet producer and of transporting and storing these pallets can be dispensed with. Instead, the starting material, which takes up a minimal amount of space, can be ordered and stored adjacent to a machine at the site of or near the user of the pallets.
- The pallets can be made extremely light, which fact facilitates the overall transportation work and means that greater loads can be transported.
- Provided the pallets are made of material which is not plastic-coated, the said pallets can be recovered in their entirety within the paper industry. By suitable sizing of the material, the pallets are nevertheless made almost completely water-proof. Should the pallets be used for energy production by firing, the gases which develop are the same as occur upon incineration of paper.
- The pallets can advantageously be used as disposable pallets, particularly in the type of industry which sets strict hygiene requirements.
- When the pallets have been finished with, they can be crushed down or compressed and in this way regain their minimal volume, before the material is recovered or burned.
- According to a preferred embodiment, the pallet can be manufactured from a reduced number of components, more specifically from blanks for the deck and blanks for the manufacturing of the base beams, which fact affords advantages in terms of logistics and production technology.

The invention also aims to provide a method for the manufacturing of the pallet, and an apparatus for the manufacturing of base beams starting from blanks which have been manufactured in advance.

The invention also aims to provide such a blank which is adapted for the manufacturing of base beams.

These and other aims and advantages of the invention can be achieved by virtue of the said invention being characterized by what is specified in the patent claims which follow. Further characteristics, aspects and advantages of the invention are evident from the following description of two conceivable embodiments of the pallet, of the blank for the manufacturing of the base beam, and of an apparatus for the manufacturing of the base beams according to a method which is included as a stage in the manufacturing of the pallets.

BRIEF DESCRIPTION OF THE FIGURES

The invention will be explained in greater detail hereinbelow with reference to the attached drawing figures, of which:

FIGS. 11*a*–11*L* is a schematic illustration of the procedure for the manufacturing of base beams.

DESCRIPTION OF A FIRST CONCEIVABLE EMBODIMENT OF THE PALLET

Figure 1:
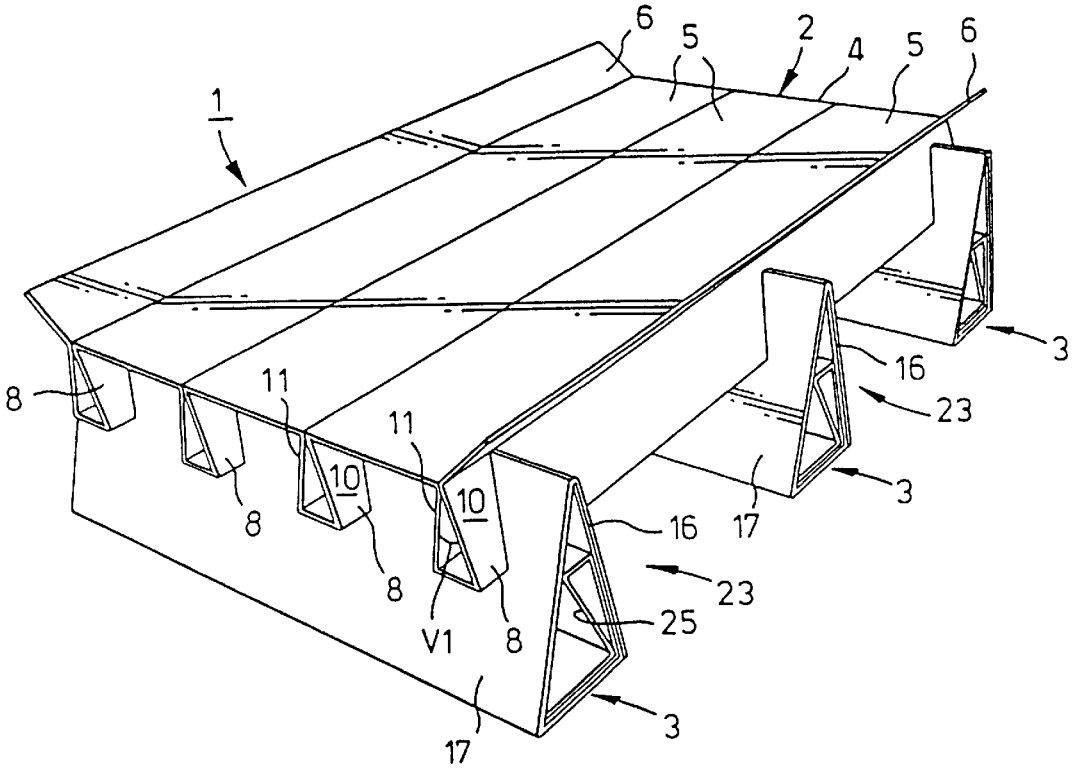
FIG. 1 represents a perspective view, obliquely from above, of a pallet according to a first conceivable embodiment of the invention.

The pallet 1 consists of the following principle parts, namely a deck 2 and a number of base beams 3, according to this embodiment three in number, which form the legs of the pallet 1. According to the embodiment, the material consists entirely of sized cardboard.

The deck 2 is manufactured from a plane sheet of sized cardboard which has been scored and folded to form a deck surface 4 consisting of a number of parallel main panels 5 and of edge panels 6 which are parallel to the main panels. A suitable material is non-plastic-coated cardboard which consists of several sized layers, each layer consisting of non-plastic-coated liquid cardboard, i.e. cardboard which has been extensively sized. In the preferred embodiment, the multi-layer cardboard has a grammage of approximately 1100 g/m$^2$. The sheet which forms the deck 2 is further folded so that the underside of the deck 2 has a number of parallel, longitudinal projections 8. The cross-section of the projections 8 has a horizontal span which increases from a position close to the deck surface 4 down towards the base 9 of the projections, which base 9 forms a lifting surface for lifting forks. To be more precise, the projections 8 have a triangular shape in cross-section, with the base 9 of the triangle constituting the said lifting surface. The said triangles are isosceles triangles and the two sides which are inclined upwards and inwards towards the vertex of the triangle have been designated by 10, 11. The main panels 5 and edge panels 6 of the deck surface 4 thus adjoin one another at the vertices of the said triangles, where the two inclined sides 10, 11 of the triangle meet. The vertex angle V1 of the triangle is approximately 30 according to the embodiment.

The base beams or the legs 3 consist, according to the embodiment, of sized, scored and folded cardboard. In cross-section, the base beams 3 have the shape of isosceles triangles with a base 15 and inclined sides 16, 17. According to the embodiment, the vertex angle V2 is also approximately 30. The sides 16, 17 of the legs 3 are almost three times as long as the sides 10, 11 of the deck projections 8.

Arranged in the base beams/legs 3 are triangular recesses 21 which, starting from the vertex 20, extend some distance down in the top portion of the base beams. The recesses 21 have the same dimension and shape as the outer cross-section of the projections 8 on the underside of the deck 2. The recesses 21 are arranged in the base beams 3 in a distribution corresponding to the width of the main panels 5 on the deck surface 4. In this way, the deck 2 can be joined by dovetailing with the base beams 3 by the projections 8 being pushed into the recesses 21 in the base beams. The triangular shape of the projections 8 is maintained in this way, and at the same time the deck 2 is anchored in the base beams, by means of the dovetailing, without the use of binders or of any securing members other than the dovetailing members themselves, i.e. the projections 8 and the recesses 21.

Spaces 23 for lifting forks are formed under the projections 8 and between the base beams/legs 3, with the lifting forks using the base 9 of the projections 8 as a lifting surface.

Figure 3:
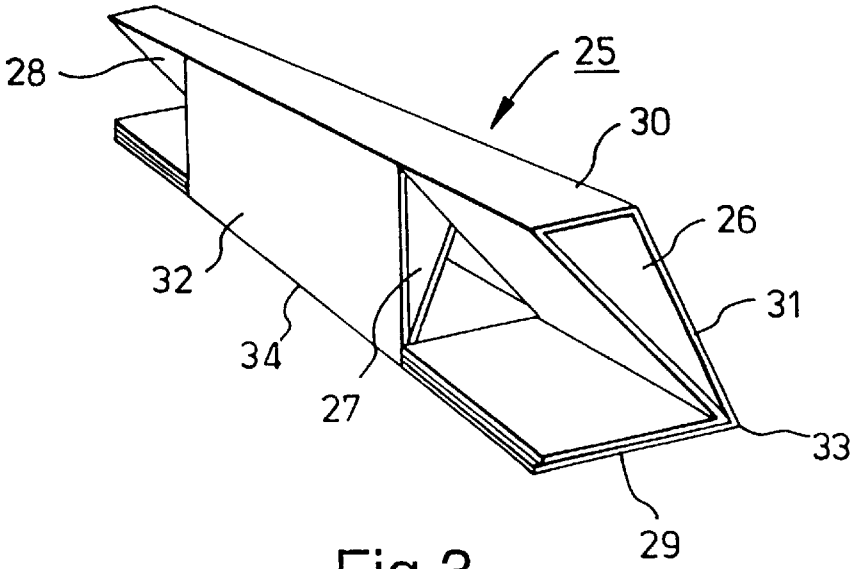
FIG. 3 represents a perspective view of a supporting member included in the pallet.

In order to stiffen the base beams/legs 3, stiffening members 25 are introduced into the base beams 3 in the spaces under the projections 8. FIG. 3 shows, on an enlarged scale, the appearance of such a stabilizing and stiffening member 25. The latter also consists of sized cardboard and is scored and folded so that oblique triangles 26, 27 and 28 are formed alternately to the left and to the right. The stiffening member is passed into the legs 3 under the projections 8 on the deck 2, so that the base 29 of the stiffening member rests against the base 15 of the base beam/leg 3, while its plane top side 30 is pressed against the base 9 of the projection 8. The outer sides 31 of the triangles 26 and 28 bear against the inside of the side 16 of the legs 3, while the corresponding outside 32 of the triangle 27 bears against the side 17 of the legs. The corners 33, 34 of the triangles 26, 27, 28 are pressed into the lower comers of the legs 3. The stiffening members 25 in this way give the legs 3 a considerably better load-bearing capacity.

Pallets 1 of the type described above can be joined together to form larger pallets both in the longitudinal direction of the panels 5, 6 and also in their transverse direction, i.e. in the longitudinal direction of the base beams 3. In the former case, the pallets 1 can be joined with the aid of triangular bars which are passed into the triangular projections 8 on the deck 2 and in such a way that they extend between the pallets which are thus joined. These triangular bars preferably consist of sized cardboard which has been folded to form triangles. In the latter case, the pallets 1 can be joined by using extended stiffening members of the same basic design as the stiffening member 25, which are passed into the base beams/legs 3 in the adjacent pallets 1 which are to be joined to each other and in such a way that they extend between the pallets which are thus joined. These two alternatives can of course be combined.

DESCRIPTION OF A SECOND, PREFERRED EMBODIMENT OF THE PALLET

Figure 2:
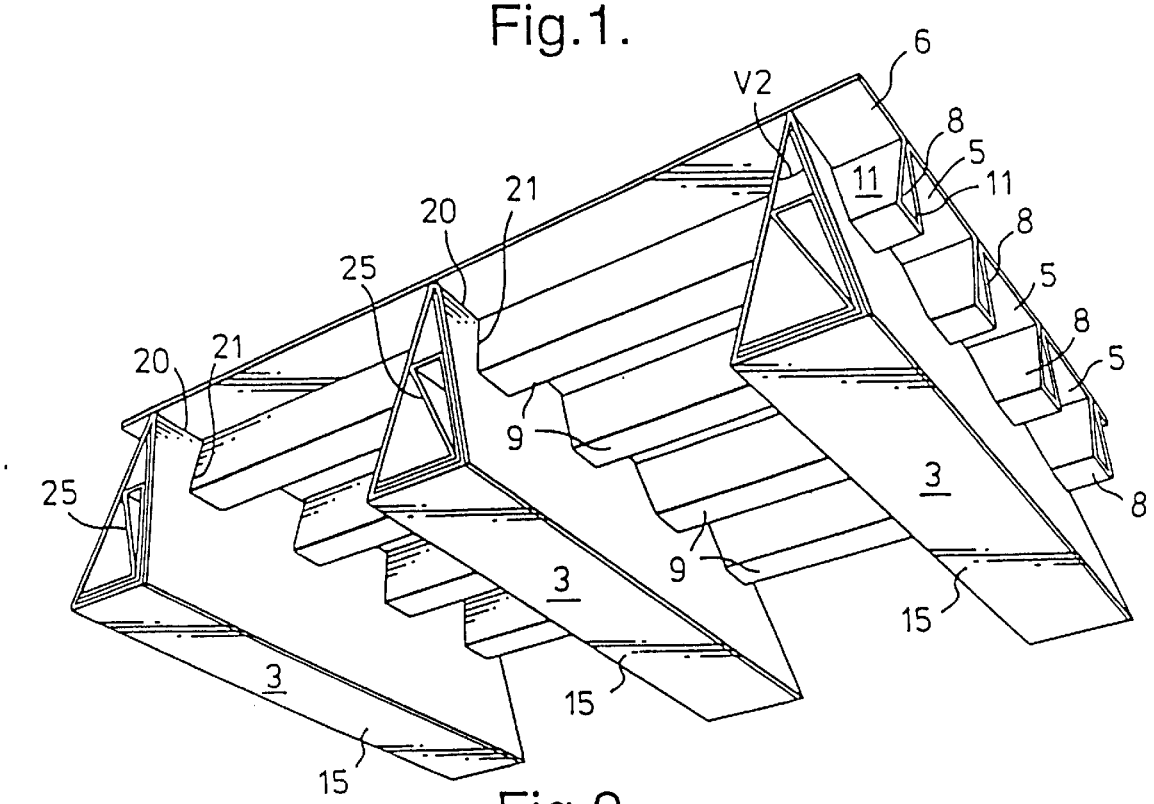
FIG. 2 shows the same pallet in an oblique view from below.
Figure 4:
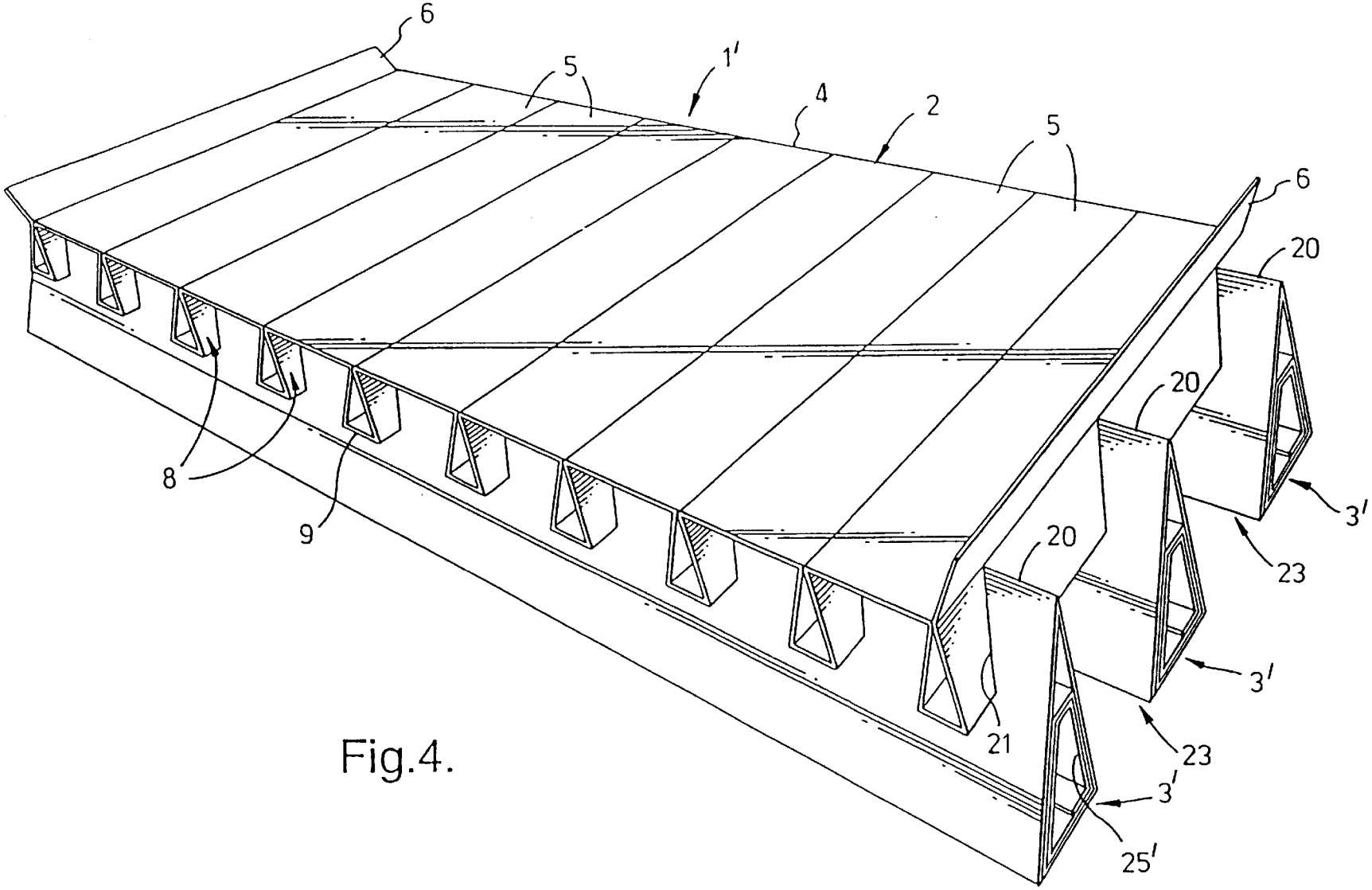
FIG. 4 represents a perspective view, obliquely from above, of a pallet according to a second, preferred embodiment of the invention.
Figure 6:
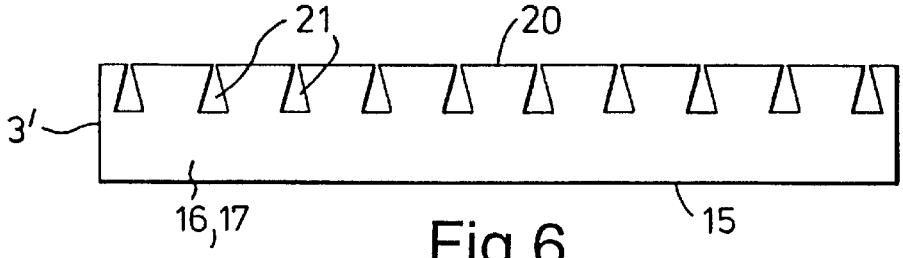
FIG. 6 shows the same base beam towards one long side, and on a smaller scale.

This embodiment is illustrated in FIG. 4 and represents an example of a so-called half pallet. (The pallet which is shown in FIGS. 1 and 2 is an example of a so-called quarter pallet). This means that the base beams are longer and that the number of projections on the underside of the deck and of corresponding recesses in the top of the base beams has been increased correspondingly. The same reference numbers have been used for parts which have a direct counterpart in the embodiment according to FIGS. 1–3, for which reason these members are not described in detail here, and instead reference is made to the preceding description of the first embodiment. As regards parts which have a counterpart, but whose construction has been modified, the same reference numbers as before are used, but with an added '.

Figure 5:
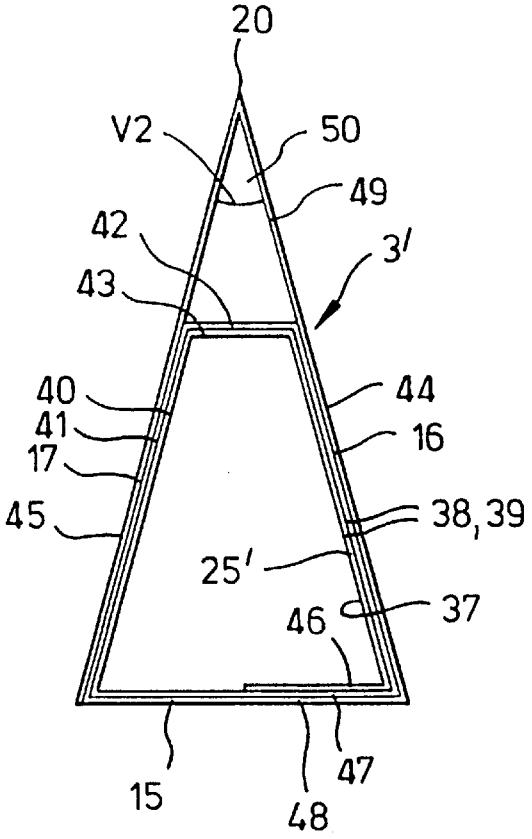
FIG. 5 shows an end view of a base beam included in the pallet according to this preferred embodiment.

The difference in relation to the preceding embodiment lies in the design of the stiffening or supporting members 25' in the base beams 3'. Whereas the stiffening members 25 in the preceding embodiment consisted of separate units which were guided into the base beams after their production, the supporting members 25' are integrated from the outset with the base beams 3' and represent above all an improvement in terms of production technology, logistics and costs. The design of a base beam 3' is shown in greater detail in FIG. 5. The supporting member 25' consists quite simply of an inner pipe 37 in the shape of a regular, isosceles parallel trapezium with an outer shape which corresponds with the shape of the lower part of the base beam 3'. To be more precise, the supporting member 25' consists of several inner turns of the material from which the base beam 3' is made. The supporting member 25' is thus formed of two inner layers 38, 39 and 40, 41, respectively, in the area of the inclined sides of the base beam, and two layers 42, 43 at the top of the supporting member 25'. The side-wall layers 38, 39 and 40, 41, respectively, are integral with the outer layers 44, 45 of the base beam 3' in the area of the two inclined sides 16, 17. The base portion 15 comprises two layers, or in one area three layers 46, 47, 48. The top portion 49 of the base beam consists of only one layer, namely the continuation of the two outer layers 44, 45, and forms an upper pipe or channel 50 of triangular cross-section above the supporting member 25'. The recesses 21 for the projections 8 on the deck 4 are formed in this top portion 49. The layers 38, 39 and 44, and the layers 40, 41 and 45, respectively, that is to say the layers in the area of the two inclined sides 16 and 17, are connected to one another by sizing, which further strengthens the integrated beam.

The connection of the different layers of the supporting member 25' to the outer layers of the base member 3', so that the outer layers of the base beam and the supporting member form an integral, connected unit, greatly strengthens the base beam 3' and increases the ability of the supporting member 25' to support the deck 2, which rests on the supporting member 25' via the projections 8. The fact that the supporting member 25' forms a lower, inner pipe 37 in the base beam 3' also allows several pallets 1' to be assembled to form larger units by means of connecting members being passed through the inner pipes 37.

The advantages in terms of production technology have been mentioned and will be further explained in the following description of the production of the pallet 1' and in particular of the base beams 3'.

DESCRIPTION OF THE PRODUCTION OF THE PALLET IN ITS PREFERRED EMBODIMENT

Figure 7:
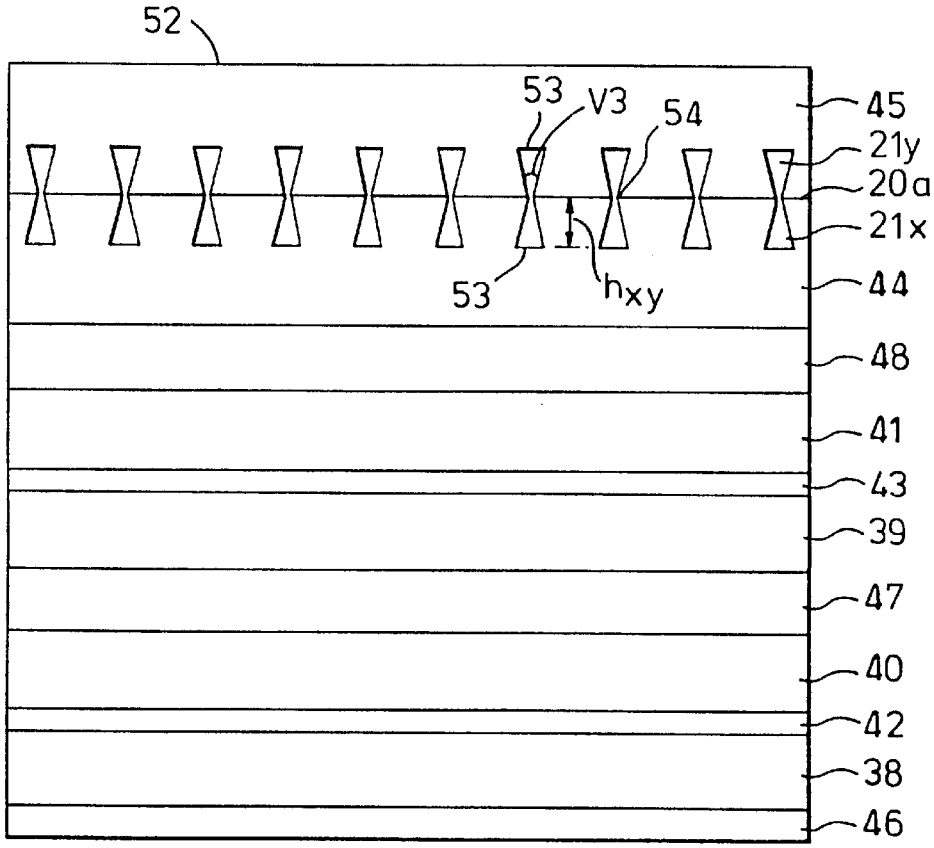
FIG. 7 represents a plan view of a blank for the manufacturing of the base beam.
Figure 8:
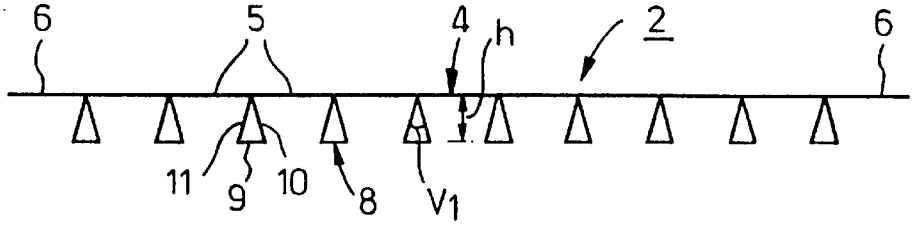
FIG. 8 is a side view of a deck before it has been joined to the base beams.

FIG. 7 shows a blank 52 for the manufacturing of a base beam 3'. It consists of a rectangular sheet of cardboard which is divided, by means of a number of parallel, transverse fold lines, into a number of parallel panels 46, 38, 42 etc., which have been given the same reference numbers as the different layers in the base beam 3' and which have been explained hereinabove with reference to FIG. 5. The two "last" panels 44, 45 which will form outer layers in the two inclined walls 16 and 17, and will form the top portion 49, are provided with a series of holes 21*x* and 21*y*, respectively, distributed along the fold line 20*a* which coincides with the vertex 20 of the base beam 3'. The shape and size of the holes 21*x* and 21*y* are such that when the beam 3' has been given its final shape and has been placed with the vertex 20 upwards, projected on a vertical centre plane through the beam, the holes 21*x* and 21*y* correspond with the outer cross-section of the projections 8. The holes 21*x* and 21*y* thus have the shape of triangles of height $h_{xy}$, where $$h_{xy} = \frac{h}{\cos\frac{V2}{2}}$$

where h is the height of the projections 8, FIG. 8, and

V2 is the vertex angle of the base beam 3'.

The base 53 of the recesses 21*x* and 21*y* corresponds with the length of the base 9 of the projections 8, which in turn means that the vertex angle V3 of the holes 21*x* and 21*y* is somewhat less than the vertex angle V1 of the projections 8 in compliance with simple trigonometric calculations.

The holes 21*x* and 21*y* are joined to each other via a narrow gap 54 which crosses over the fold line 20*a*. The extent hxy of the recesses 21*x* and 21*y* from the fold line 20*a* is less than half the width of the panels 44 and 45, more precisely about one third of the width of the panels 44 and 45.

All the other panels, i.e. all the panels other than the two "last" panels 44, 45, are entirely devoid of holes.

Figure 9:
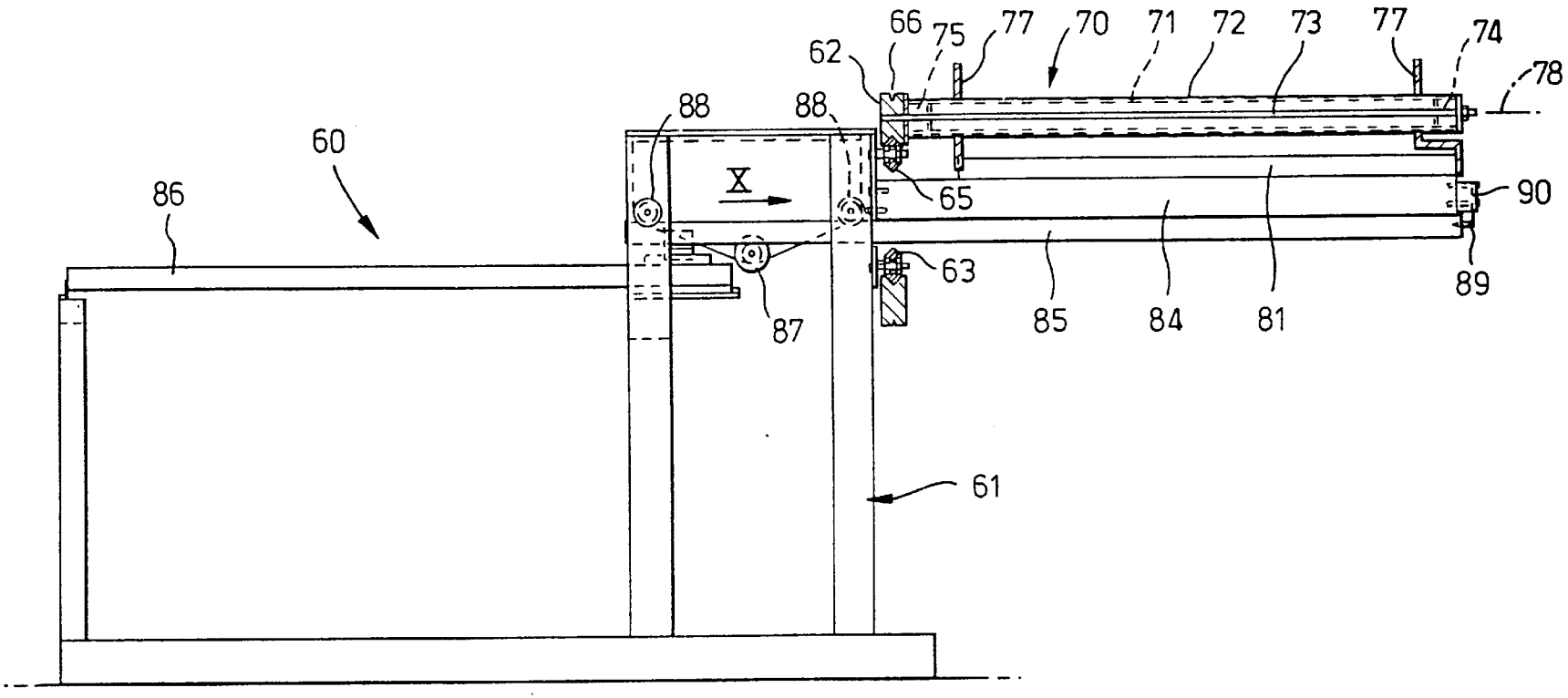
FIG. 9 is a side view of an apparatus for the manufacturing of base beams from blanks according to FIG. 7.
Figure 10:
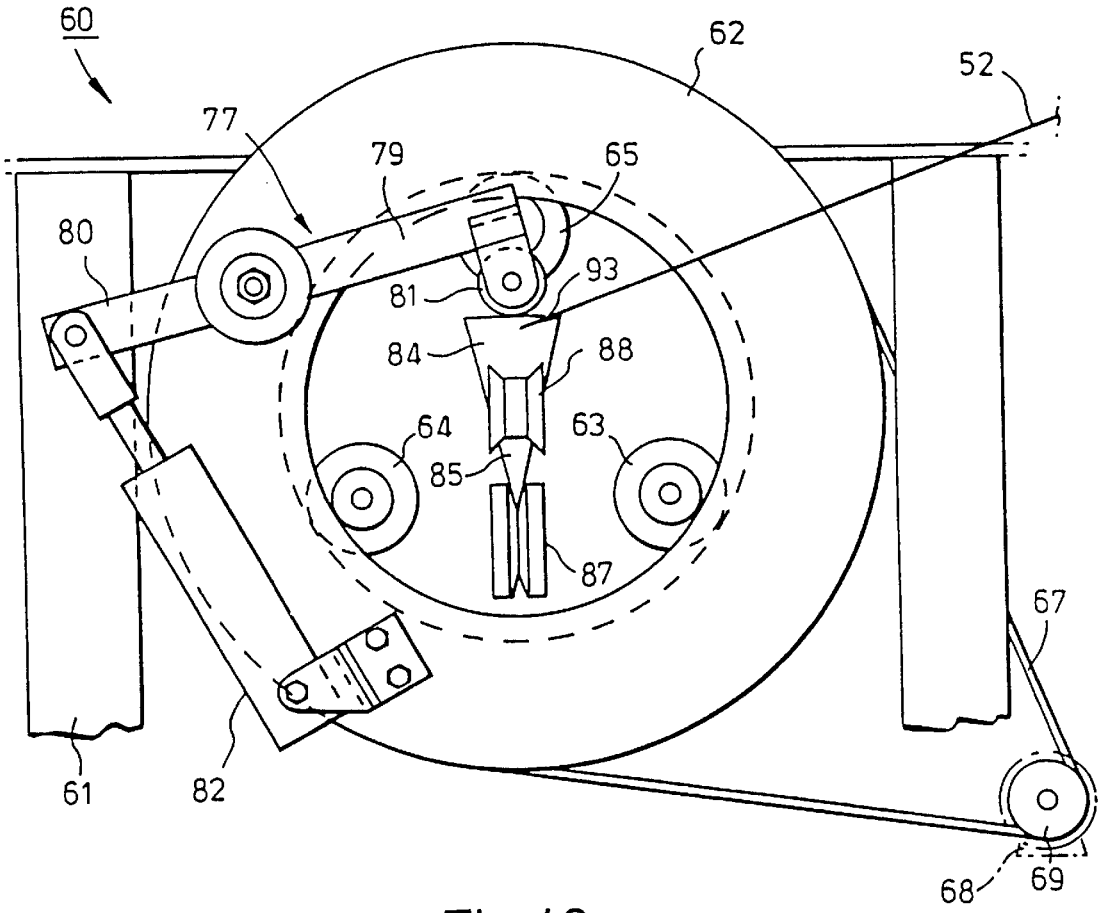
FIG. 10 shows, on a larger scale, the upper parts of the apparatus in the direction of the arrow X in FIG. 9.

FIGS. 9 and 10 show, somewhat schematically, an apparatus 60 for the production of base beams 3' from blanks 52, FIG. 7, with certain details having been omitted from the figures so that the essential features can better be seen. A ring 62 is mounted on a stand 61 so that it can rotate about three supporting rollers 63, 64, 65 which are mounted rotatably on the stand 61. The ring 62 has on the outside a V-belt groove 66 for a V-belt 67 which can be driven by a motor 68 via a drive wheel 69, FIG. 10, not shown in FIG. 9, for rotation of the ring 62.

Extending horizontally outwards from the ring 62 is a carrier, generally designated by 70. The carrier 70 consists of an inner pipe 71, an outer pipe 72, a middle screw 73 and bushes 74, 75 at the ends. This arrangement permits a high bending resistance of the unit 70, at the same time as the outer pipe 72 can be rotated about the inner pipe 71.

A pair of double-armed levers 77 are mounted on the outer pipe 72, near its outer ends, in such a way that they can be rotated together with the outer pipe 72 about its central axis 78. A press roller 81, facing towards the centre of the ring 62, is mounted rotatably between the two outer arms 79 and is arranged to be pressed in a direction in towards the centre of the ring 62 under the effect of a pneumatic cylinder 82 which is arranged as a compression spring and which acts on the other two arms 80. The pneumatic cylinder 82 is mounted rotatably on the ring 62.

A member 84 also extends horizontally outwards from the stand 61 parallel with the carrier 70 and with the press roller 81, and it extends as far as the outer end of the roller 81. The member 84 is referred to hereinafter as the inner core since it is intended to form a counterstay upon winding of the blank 52 into a pipe, a priori upon winding of the inner pipe 37 which is to form a stiffening member/bearing support 25'. The core 84 has an outer contour corresponding to the inner shape of the supporting member 25'/inner pipe 37, i.e. it has the shape of an isosceles parallel trapezium.

There is also a second, outer core 85 which in cross-section has the shape of a triangle with the same contour as the channel 50 in the top of the base beam 3'. This outer core 85 is arranged, in the apparatus 60, below the inner core 84 and can be displaced to and fro in a horizontal direction with the aid of a belt cylinder (so-called Origa® cylinder) 86. The upper and lower supporting rollers for the outer core 85 have been designated 87, 88. FIG. 9 shows the core 85 in its advanced operational position, where it is connected at its front end to the inner core 84 by way of a dowel 89 which engages in a hole (not shown) in the outer end of the core 85. The dowel 89 is supported, in a manner such that it can be moved aside, by a holder 90 at the outer end of the inner core 84 and fixes the two cores 84, 85 to each other in the operational position of the outer core 85. The outer core 85 can be guided to and from its operational position via the ring 62 with the aid of the belt cylinder 86. There are also two glue guns which have been designated schematically by 92 in FIG. 11. These can also be moved to and fro via the ring 62 with the aid of movement members, for example a belt cylinder, in the same way as the outer core 85.

The production of a base beam 3' will now be explained with reference also to FIG. 11. In the starting position, the ring 62 is in the position shown in FIG. 10, which corresponds to stage A in FIG. 11. The blank 52 is guided by the panel 46 into a slot 93 in the inner core 84. The working of the apparatus 60 is controlled by a microprocessor (not shown) in conjunction with sensors (not shown). From the starting position shown at stage A, the ring 62 is turned clockwise, and the press roller 81 guides the blank 52 downwards by the panel 38 on the first inclined side of the core 84, stage B. In the next phase, stage C, the first narrow panel 42 is folded in under the core 84. Thereafter, stage D, the panel 40 is folded by the press roller 81 up against the second inclined side of the core 84. The first turn is completed at stage E, when the panel 47 is folded in over the core 84. In this position, the ring 62 stops under the command of the said sensors (not shown). The spray pistols 92 are guided in through the ring 62 by movement and carrier members (not shown). The spray pistols 92 are advanced as far as the end of the core 84 and then back again. During the advance and return movement, the panels 38 and 40 are sprayed with glue. The ring 62 is then rotated one turn further, stages F, G, H and I. During these stages, the panels 39, 43, 41 and 48 are folded in against the respective sides, with the material in the panels 39 and 41 being joined to the panels 38 and 40 by means of the strands of glue applied in stage E. At stage I, the ring 62 is once again stopped. The glue pistols 92 are guided anew through the ring 62 and spray the panels 39 and 40 with glue during the return movement. The outer core 85 is guided into position under the inner core 84 and is fixed in this position by the said dowel 89, FIG. 9. The remaining material, the folds 44 and 45 with the holes 21*x* and 21*y*, is then folded in, stages J and K, and fixed to the glue-coated panels 39 and 41. The outer core 85 is withdrawn from the triangle-shaped channel 50 which is formed. Finally, the ring 62 is turned to its starting position, stage L, with the press roller 81 bearing against the base 15 of the base beam 3' which has thus been formed. The dowel 89 is moved aside and the finished base beam 3' is withdrawn from the apparatus 60 to the right in FIG. 9.

The deck 2 is also manufactured from a scored blank which is folded to give the shape which is shown in FIG. 8. Finally, this deck 2 is joined to a number of base beams 3', of which there are three in the present embodiment, by means of the triangle-shaped projections 8 being introduced into the recesses 21 in the top portion 49 of the base beam.

GENERAL COMMENTS

It will be appreciated that the invention can be varied within the scope of the patent claims which follow. A fundamental idea behind the construction of the pallet is that the load-bearing capacity of the pallet is in the first instance determined by the strength of the lower portions of the base beams 3, 3', while the top portion of the base beams in the first instance serves to fix the deck 2 to the base beams 3, 3'. The material making up the base beams has therefore been concentrated in the said lower portion, the thickness of which, according to the preferred embodiment, consists of three layers and which consequently forms, together with the connecting panels 42, 43, a powerful bearing support for the projections 8 on the deck. Alternatively, a separate supporting member 25 is introduced as a bearing support into the base beams. It will be appreciated, however, that the embodiments which have been shown are only examples and do not limit the claimed patent protection. It will also be appreciated that the shape of the base beams 3, 3' in particular can be varied. The triangular cross-section of the base beams is preferable, and it is of particular advantage for the sides of the base beams to be inclined. This shape, which is advantageous from the point of view of strength, can also be achieved using base beams whose cross-section is in the shape of an isosceles parallel trapezium with inclined walls and with a narrower side directed upwards, bearing against the top side of the deck 4, and the recesses for the projections 8 also extending over such an upper side of the base beams. It will also be appreciated that material other than cardboard can conceivably be used for the manufacturing of the deck and base beams. For example, it is conceivable to produce the deck and base beams using plastic sheets, expediently comprising recycled plastic, with the fold lines being formed by means of grooves in the plastic sheets. In this case, the various layers in the base beams can be fixed to one another by heat sealing, for example. The method for producing the pallet and in particular the base beams can also be varied. For example, instead of winding the blank around stationary cores, it is possible to rotate the cores around a central axis, pulling on an otherwise stationary blank.

I claim:

1. A pallet, comprising:

a plurality of parallel base beams;

a deck joined to the plurality of parallel base beams, said deck comprising a web or sheet of material, said web or sheet of material being folded to form a deck surface with a plurality of parallel panels adjoining each other and a plurality of parallel projections on an underside thereof, and wherein each base beam of the plurality of parallel base beams extends upward to contact the underside of the parallel panels, and including at least one through-recess having a shape which corresponds to a cross-section of a corresponding one of said plurality of parallel projections, wherein the corresponding parallel projection engages the at least one recess thereby forming the pallet with a plurality of spaces to accommodate lifting forks between the plurality of parallel base beams, wherein lower surfaces of the plurality of parallel projections forms lifting surfaces for the lifting forks.

2. A pallet according to claim 1, wherein the cross-section of the corresponding parallel projection has a width which increases from a first width at a position close to the deck surface to a second width at a position toward a lifting surface thereof, said second width being greater than said first width.

3. A pallet according to claim 2, wherein the cross-section of the corresponding projection and recess is in a dovetail shape.

4. A pallet according to claim 1, wherein each of the plurality of parallel projections has a triangular cross-sectional shape, with a base of the triangular shape forming a lifting surface.

5. A pallet as recited in claim 1, wherein each of the plurality of base beams has a polygonal cross-section with inclined side walls formed by folds of the web or sheet.

6. A pallet as recited in claim 5, wherein said polygonal cross-section is in a shape of a triangle.

7. A pallet as recited in claim 6, wherein triangles formed by the triangular cross-section are isosceles triangles, with the two inclined surfaces forming the sides of the triangle, with an angle between the inclined side walls being between 20° and 40°.

8. A pallet as recited in claim 7, wherein the grammage is in the range of 900–1,200 g/m$^2$.

9. A pallet as recited in claim 7, wherein the angle is between 25° and 35°.

10. A pallet as recited in claim 1, wherein each base beam of the plurality of base beams has a cross-section in a shape of an isosceles triangle, with an angle between sides of the isosceles triangle being between 20° and 40°.

11. A pallet as recited in claim 10, wherein the angle is between 25° and 35°.

12. A pallet as recited in claim 1, further comprising stiffening members engaging an underside of the plurality of parallel projections.

13. A pallet as recited in claim 12, wherein the stiffening members each comprise a separate stiffening element, each stiffening element being disposed within a corresponding one of the plurality of base beams.

14. A pallet as recited in claim 12, wherein each of the plurality of parallel base beams comprise a folded material having a polygonal cross-section, folded in a winding of at least two turns, with a first turn forming an outer periphery of the base beam and a second turn forming the stiffening member.

15. A pallet as recited in claim 14, wherein the second turn forming the stiffening member has a cross-sectional shape of a symmetrical parallel trapezium.

16. A pallet as recited in claim 14, wherein each base beam and supporting member comprises a single piece of material folded to form the base beam and the supporting member.

17. A pallet as recited in claim 1, wherein said foldable material comprises multi-layer cardboard having grammage in the range of 700–1,500 g/m$^2$.

18. A pallet as recited in claim 17, wherein the grammage is in the range of 800–1,400 g/m$^2$.

19. A pallet as recited in claim 1, wherein the material comprises multi-layer cardboard comprising 3–5 layers of non-plastic-coated cardboard.

20. A pallet unit comprising at least two pallets according to claim 1, wherein the at least two pallets are joined to each other by connecting members extending through each of the plurality of base beams.

21. A pallet as recited in claim 1, wherein each base beam of the plurality of parallel base beams comprises a sheet of foldable material, said sheet being separated into a plurality of panels having a length which exceeds a width thereof, said plurality of panels being separated by fold lines, with an adjacent pair of said plurality of panels sharing a common aperture at a common fold line, with the common aperture being narrower at the fold line than at a position away from the fold line, the aperture comprising two halves, with a first half being on a first panel of the pair of adjacent panels and a second half being on a second panel of the pair of adjacent panels, with the second half of the aperture being a mirror-inverted version of the first half of the aperture.

22. A pallet as recited in claim 21, wherein the common aperture is disposed in panels which form sides of the base beam, at a top portion thereof, and wherein no apertures exist in other panels of the base beam.

23. A pallet as recited in claim 22, wherein the fold line on which the aperture is disposed is separated from an outer edge of the sheet of foldable material by one panel of the plurality of panels.

24. A pallet as recited in claim 21, wherein the first half and the second half of the aperture each has a shape of an isosceles acute-angle triangle, each with an apex thereof on the fold line, and with bases of the triangles parallel to the fold line.

25. A method for manufacturing a pallet, said method comprising the steps of:

providing a first blank of foldable material to form at least one base beam of a plurality of parallel base beams;

winding the first blank of foldable material along fold lines to form the base beam, such that the base beam includes an inner pipe forming a stiffening member in a lower part of the base beam by a first winding turn, and forming an outer surface of the base beam by a second winding turn such that apertures in the panel form recesses in sides of the base beam;

adhering a portion of the winding turns to each other with an adhesive;

providing a second blank of foldable material to form a deck surface;

rotating the second blank of foldable material along fold lines to form the deck surface, said deck surface comprising a plurality of parallel panels adjacent to each other and parallel projections on an underside of the deck surface, said parallel projections having a cross-section which corresponds to cross-section of the base beam; said method further comprising the step of:

joining the deck to the base beam by engaging the projections on the underside of the deck with the recesses in the base beam.

26. A method according to claim 25, wherein said step of joining the deck to the base beam comprises joining the deck to a plurality of base beams.

27. A method as recited in claim 25, wherein said step of winding the first blank into the base beam comprises winding the first winding turn on a first core, and winding the second winding turn on a second core, to form the base beam.

* * * * *